US010538961B2

(12) United States Patent
Chen

(10) Patent No.: US 10,538,961 B2
(45) Date of Patent: Jan. 21, 2020

(54) DUAL-USE POLE FOR NON-CORD WINDOW BLIND ASSEMBLY AND BLIND SLAT LIFT MECHANISM USING SAME

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 172 days.

(21) Appl. No.: 15/715,922

(22) Filed: Sep. 26, 2017

(65) Prior Publication Data

US 2018/0087317 A1 Mar. 29, 2018

(30) Foreign Application Priority Data

Sep. 26, 2016 (TW) ..... 105131013 A

(51) Int. Cl.

*E06B 9/322* (2006.01)
*E06B 9/307* (2006.01)
*E06B 9/28* (2006.01)

(52) U.S. Cl.

CPC ..... *E06B 9/322* (2013.01); *E06B 9/307* (2013.01); *E06B 2009/285* (2013.01); *E06B 2009/3222* (2013.01)

(58) Field of Classification Search

CPC .. E06B 2009/3222; E06B 9/322; E06B 9/307; E06B 9/388; E06B 2009/285; E06B 9/326; E06B 9/78; A47F 13/06; B25J 1/04

USPC ..... 16/422, 426, DIG. 5; 294/19.1, 32, 22, 294/175, 191

See application file for complete search history.

(56) References Cited

U.S. PATENT DOCUMENTS 3,011,813 A * 12/1961 Arneson ..... B25G 3/10 279/2.17
4,776,361 A * 10/1988 Staton ..... A45B 3/00 135/65
4,875,516 A * 10/1989 Marocco ..... E06B 9/307 160/178.1 R
6,805,186 B1 * 10/2004 Nien ..... E06B 9/322 160/177 R
7,748,430 B1 * 7/2010 Hung ..... E06B 9/262 160/84.01
7,793,701 B2 * 9/2010 Liang ..... E06B 9/322 16/422
2007/0084567 A1 * 4/2007 Chen ..... E06B 9/32 160/84.05
2011/0259533 A1 * 10/2011 Lin ..... E06B 9/42 160/340

* cited by examiner

*Primary Examiner* — Catherine A Kelly
*Assistant Examiner* — Jeremy C Ramsey
(74) *Attorney, Agent, or Firm* — Muncy, Geissler, Olds & Lowe, P.C.

(57) ABSTRACT

A dual-use pole used in a non-cord window blind assembly is provided to have a pole shank and a pole head. The pole head has a flange and a driving block. The flange has an end surface located at an end of the pole shank. The driving block is located at an opposing end surface of the flange and it is used to connect and drive a blind slat tilt adjuster to further adjust the tilt angle of the blind slats.

4 Claims, 5 Drawing Sheets

DUAL-USE POLE FOR NON-CORD WINDOW BLIND ASSEMBLY AND BLIND SLAT LIFT MECHANISM USING SAME

BACKGROUND OF THE INVENTION

1. Field of the Invention

The present invention relates to non-cord window blind and more particularly, to a dual-use pole for non-cord window blind assembly and a blind slat lift mechanism using the dual-use pole.

2. Description of the Related Art

Structurally speaking, common window blinds can be classified into two types, namely pull-cord window blind type and non pull cord window blind type. The type of pull-cord window blind uses a pull cord for pulling to move the blind between an extended status and a received status. The type of non pull cord window blind utilizes the force exerted by hand to pull down or lift the bottom rail, enabling the blind slats to be extended out or received.

However, if the type of non pull cord window blind is mounted at a high location, a user needs to stand on a chair, box or other support stuff so that the user can reach the bottom rail to lift or pull down the bottom rail. This operation manner is quite inconvenient for the user.

SUMMARY OF THE INVENTION

The present invention has been accomplished under the circumstances in view. It is an object of the present invention to provide a dual-use pole for non-cord window blind assembly, which can be used, on one hand, for adjusting the tilt angle of the blind slats, one the other hand, for lifting or pulling down the blind slats.

To achieve this object, a dual-use pole in accordance with the present invention is provided to comprise a pole shank and a pole head. The pole head comprises a flange and a driving block. The flange has an end surface located at an end of the pole shank to cooperate with a bottom rail. The driving block is located at an opposing end surface of the flange and it is used to cooperate with a blind slat tilt adjuster. Thus, the dual-use pole can be used for driving the blind slat tilt adjuster to adjust the tilt angle of the blind slats by the driving block of the pole head. Further, the dual-use pole can be either used to exert lifting force toward the bottom rail via the flange, or used to attached to the bottom rail to further pull down the bottom rail, enabling lowering or receiving the blind slats.

It is another object of the present invention to provide a blind slat lift mechanism using the aforesaid dual-use pole.

To achieve this object, a blind slat lift mechanism in accordance with the present invention is provided to comprise a bottom rail and the aforesaid dual-use pole. The bottom rail comprises a first through hole, and a second through hole in communication with the first through hole. The first through hole has a pore size smaller than the second through hole. The flange of the dual-use pole has a diameter larger than the pore size of the first through hole of the bottom rail but smaller than the pore size of the second through hole. Thus, when the dual-use pole is in a first operating position, the flange of the pole head is abutted against a bottom surface of the bottom rail and the driving block of the pole head is inserted through the first through hole into the inside of the bottom rail so that the dual-use pole is operable to lift the bottom rail and to further receive the blind slats; when the dual-use pole is in a second operating position, the flange of the pole head is moved from a place where the flange is inserted inside the bottom rail through the second through hole to a place where the flange is located above the first through hole and supported by the bottom rail. At this time, the pole shank protrudes out of the bottom rail through the first through hole, so that the dual-use pole is operable to pull down the bottom rail to further lower the blind slats.

Other advantages and features of the present invention will be fully understood by reference to the following specification in conjunction with the accompanying drawings, in which like reference signs denote like components of structure.

DETAILED DESCRIPTION OF THE INVENTION

Figure 3:
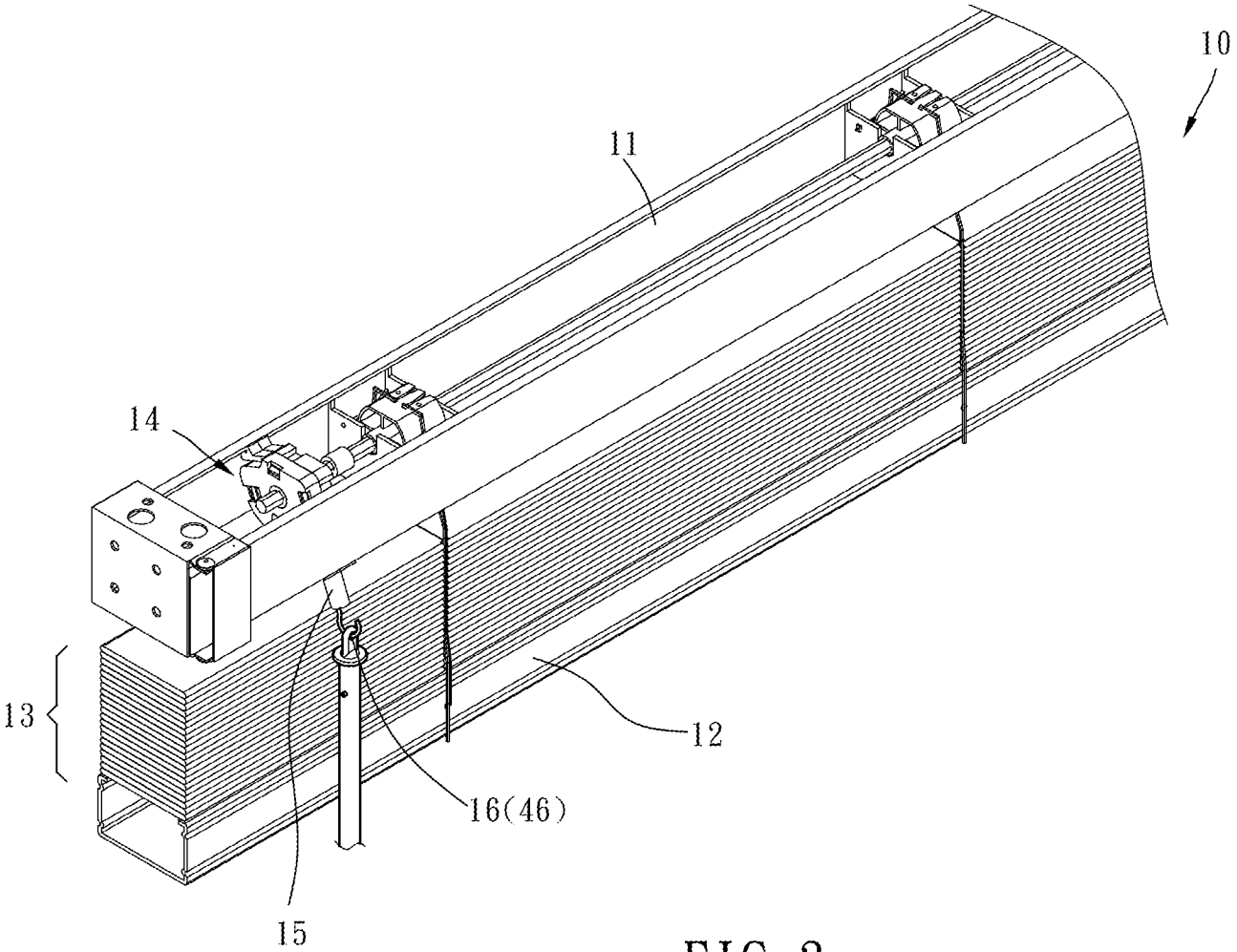
FIG. 3 is an oblique elevational view of the present invention, illustrating the dual-use pole coupled to a blind slat tilt adjuster of a non-cord window blind assembly in accordance with the present invention.

Referring to FIG. 3, a non-cord window blind assembly 10 is shown. The non-cord window blind assembly 10 comprises a headrail 11, a bottom rail 12, a set of blind slats 13 arranged between the headrail 10 and the bottom rail 12, and a blind slat tilt adjuster 14 mounted in the headrail 11. The blind slat tilt adjuster 14 comprises an adjustment member 15. When rotating the adjustment member 15, the blind slat tilt adjuster 14 is driven to adjust the tilting angle of the blind slats 13. As the blind slat tilt adjuster 14 is of the known art, to save space, the structural details and functioning of the blind slat tilt adjuster 14 will not be repeated here.

Figure 1:
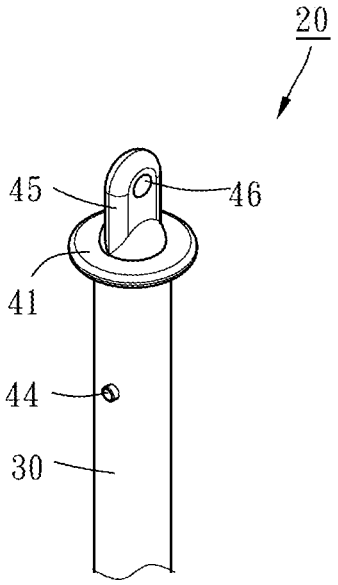
FIG. 1 is an oblique elevational view of a dual-use pole in accordance with the present invention.
Figure 2:
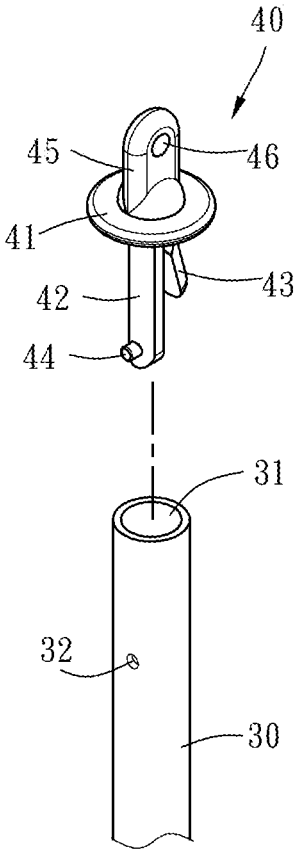
FIG. 2 is an exploded view of the dual-use pole in accordance with the present invention.

Referring to FIGS. 1 and 2, a dual-use pole 20 in accordance with the present invention comprises a pole shank 30 and a pole head 40.

The pole shank 30 defines an axial hole 31 and a transverse locating hole 32. The transverse locating hole 32 is located near one end of the pole shank 30 and radially disposed in communication with the axial hole 31.

The pole head 40 comprises a flange 41, an extension arm 42, and a resilient arm extended from one end surface of the flange 41. The extension arm 42 is inserted into the axial hole 31 of the pole shank 30 and has a positioning peg 44 at an end of the extension arm 42. The positioning peg 44 is resiliently engaged with the transverse locating hole 32 of the pole shank 30. The resilient arm 43 is inserted into the axial hole 31 of the pole shank 30 to abut against an inside wall of the pole shank 30. Thus, the pole head 40 is detachably fastened to the top end of the pole shank 30, and can be detached from the pole shank 30 for replacement in case of damage.

The pole head 40 further comprises a driving block 45 extended from an opposite end surface of the flange 41 and adapted for driving the adjustment member 15 of the blind slat tilt adjuster 14, as shown in FIG. 3. Further, the driving block 45 has a hook hole 46. The adjustment member 15 has a hook 16, which is detachably connected to the hook hole 46. Thus, the dual-use pole 20 is operable to drive the blind slat tilt adjuster 14.

Figure 4:
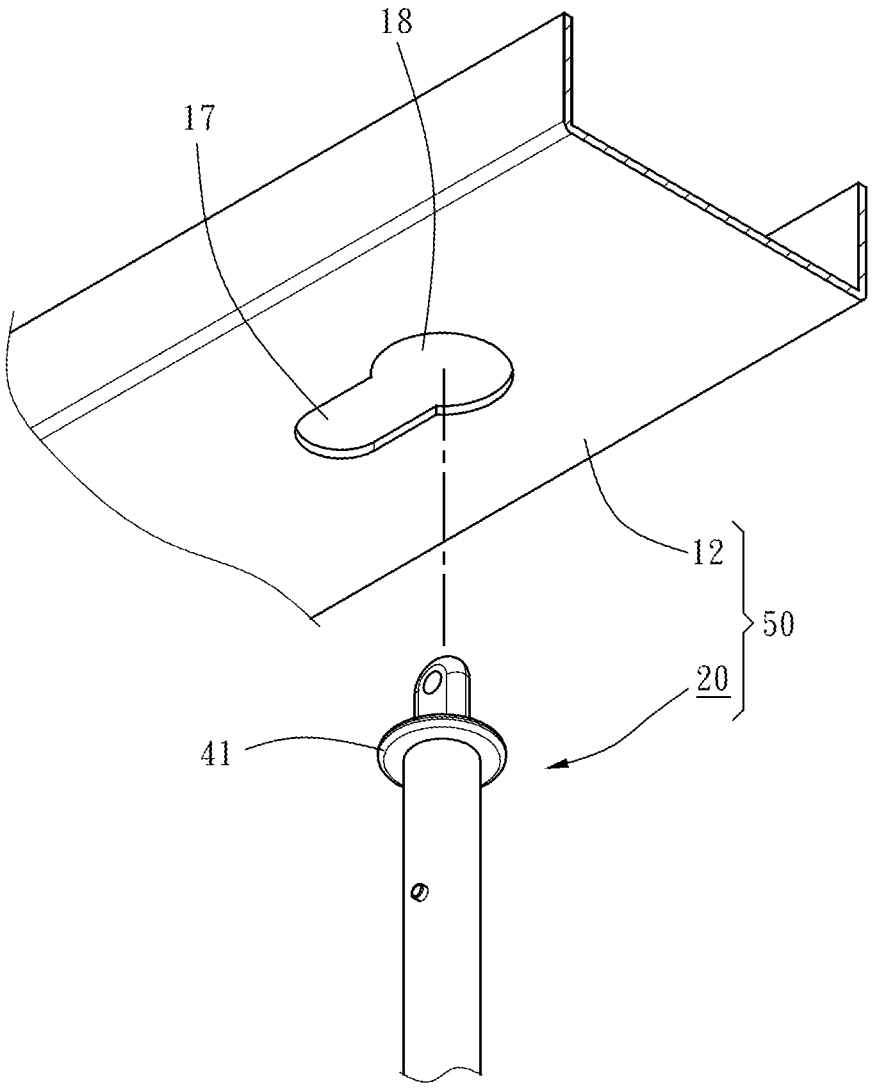
FIG. 4 is an exploded view of a window blind lift mechanism in accordance with the present invention.

In order to mate with the dual-use pole 20, as shown in FIG. 4, the bottom rail 12 is configured to provide a first through hole 17 and a second through hole 18 in communication with the first through hole 17. The size of the first through hole 17 is smaller than the size of the second through hole 18. Further, the diameter of the flange 41 of the dual-use pole 20 is larger than the size of the first through hole 17 but smaller than the size of the second through hole 18.

Figure 5:
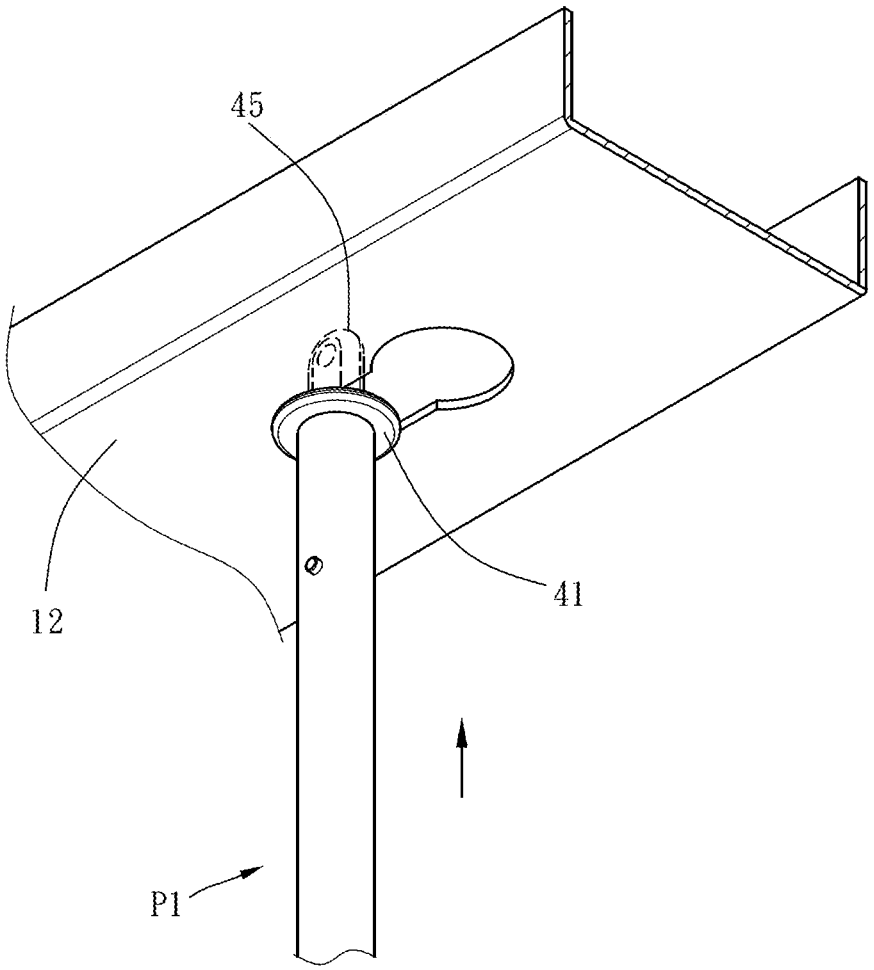
FIG. 5 is an oblique elevational view of the blind slat lift mechanism, illustrating the dual-use pole in a first operating position.
Figure 6:
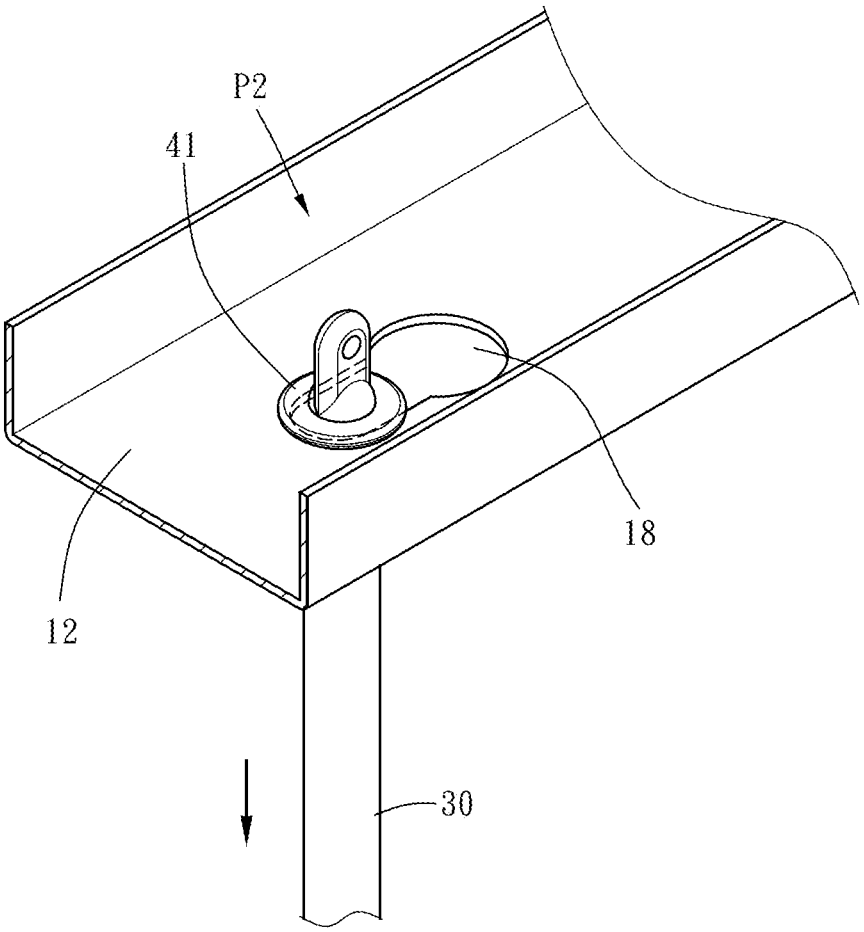
FIG. 6 is an oblique elevational view of the blind slat lift mechanism, illustrating the dual-use pole in a second operating position.

Thus, when the dual-use pole 20 is set in a first operating position P1, as shown in FIG. 5, the flange 41 of the pole head 40 is directly abutted against the bottom surface of the bottom rail 12 and the driving block 45 of the pole head 40 is inserted through the first through hole 17 into the inside of the bottom rail 12. So, the pole head 40 is capable of lifting the bottom rail 12 to receive the blind slats 13. Alternatively, when the dual-use pole 20 is set in a second operating position P2, as shown in FIG. 6, the flange 41 of the pole head 40 is inserted through the second through hole 18 into the inside of the bottom rail 12. Then, the pole head 40 can be moved to a place above the first through hole 17 to make the flange 41 of the pole head 40 be supported on the bottom rail 12. At this time, the pole shank 30 protrudes out of the bottom rail 12 through the first the first through hole 17. So that, the dual-use pole 20 is capable of being used to pull the bottom rail 12 downwards so as to extend out (lower) the blind slats 13.

In general, the dual-use pole 20 can be used for driving the blind slat tilt adjuster 14 to adjust the tilt angle of the blind slats 13, and can also be coupled to the bottom rail 12 to constitute a blind slat lift mechanism 50 for lifting or lowering the blind slats 13, achieving the object of use convenience.

What is claimed is:

1. A blind slat lift mechanism used in a non-cord window blind assembly comprising a blind slat tilt adjuster, said blind slat tilt adjuster comprising an adjustment member, the blind slat lift mechanism, comprising:

a bottom rail comprising a first through hole and a second through hole in communication with said first through hole, said first through hole having an opening size smaller than said second through hole; and a dual-use pole comprising:

a pole shank; and a pole head comprising a flange and a driving block, said flange having an end surface located at an end of said pole shank, said driving block being located at an opposing end surface of said flange and detachably connectable to said adjustment member of said blind slat tilt adjuster, said flange of said dual-use pole having a diameter larger than the opening size of said first through hole of said bottom rail but smaller than the opening size of said second through hole;

when said dual-use pole is set in a first operating position, said flange of said pole head is abutted against a bottom surface of said bottom rail and said driving block of said pole head is inserted through said first through hole of said bottom rail into an inside of said bottom rail so that said dual-use pole is capable of lifting said bottom rail; when said dual-use pole is set in a second operating position, said flange of said pole head is supported by said bottom rail, and said pole shank protrudes out of the said bottom rail through said first through hole, so that said dual-use pole is capable of pulling said bottom rail downwards.

2. The blind slat lift mechanism as claimed in claim 1, wherein said pole shank comprises an axial hole and a transverse locating hole located at one end thereof radially in communication with said axial hole; said pole head further comprises an extension arm extended from the end surface of said flange of said pole shank; said extension arm further comprises a positioning peg located at an end of said extension arm, and said positioning peg is detachably engaged with said transverse locating hole of said pole shank.

3. The blind slat lift mechanism as claimed in claim 2, wherein said pole head further comprises a resilient arm extended from said end surface of said flange facing said pole shank and inserted into said axial hole of said pole shank to abut against an inside wall of said pole shank.

4. The blind slat lift mechanism as claimed in claim 1, wherein said adjustment member of said blind slat tilt adjuster comprises a hook; said driving block has a hook hole and said hook hole is detachably connected to said hook.

* * * * *